United States Patent [19]

Bull et al.

[11] 4,330,022

[45] May 18, 1982

[54] TRANSPARENT OVERLAY DEVICE FOR PROTECTING MESH SCREENING

[76] Inventors: Ada M. Bull; George R. Bull, both of 1643 Edmonton, Sunnyvale, Calif. 94087

[21] Appl. No.: 15,932

[22] Filed: Feb. 28, 1979

[51] Int. Cl.[3] ..... E06B 9/52

[52] U.S. Cl. ..... 160/379; 49/462; 160/380

[58] Field of Search ..... 160/182, 371, 379, 100, 160/237, 380; 49/462; 24/217 R

[56] References Cited

U.S. PATENT DOCUMENTS

| | | | |
|---|---|---|---|
| 2,854,072 | 9/1958 | Winnan | 160/180 |
| 3,261,393 | 7/1966 | Templetin | 160/237 |
| 3,605,854 | 9/1971 | Majeske | 160/371 |
| 3,757,389 | 9/1973 | Wiland | 24/217 R X |
| 3,838,539 | 10/1974 | Gronowicz | 49/462 |
| 3,916,756 | 11/1975 | Yoda | 24/217 R X |
| 4,002,195 | 1/1977 | Nagase | 160/379 |
| 4,233,715 | 11/1980 | McDermott | 24/217 R |

*Primary Examiner*—Rodney H. Bonck

*Attorney, Agent, or Firm*—C. Michael Zimmerman

[57] ABSTRACT

The device consists of a pair of semicircular, transparent sheets of resilient plastic material, one of the sheets having molded on one surface a series of pegs which are insertable through the mesh of the screening. The other sheet has a corresponding pattern of holes to receive the pegs such that the two semicircular sheets can be secured together with a portion of screening between them in sandwich fashion. The device is used to reinforce and protect the mesh screening adjacent to the handle of a screen door so that bulging or accidental puncturing of the screening is avoided.

2 Claims, 3 Drawing Figures

FIG. 2
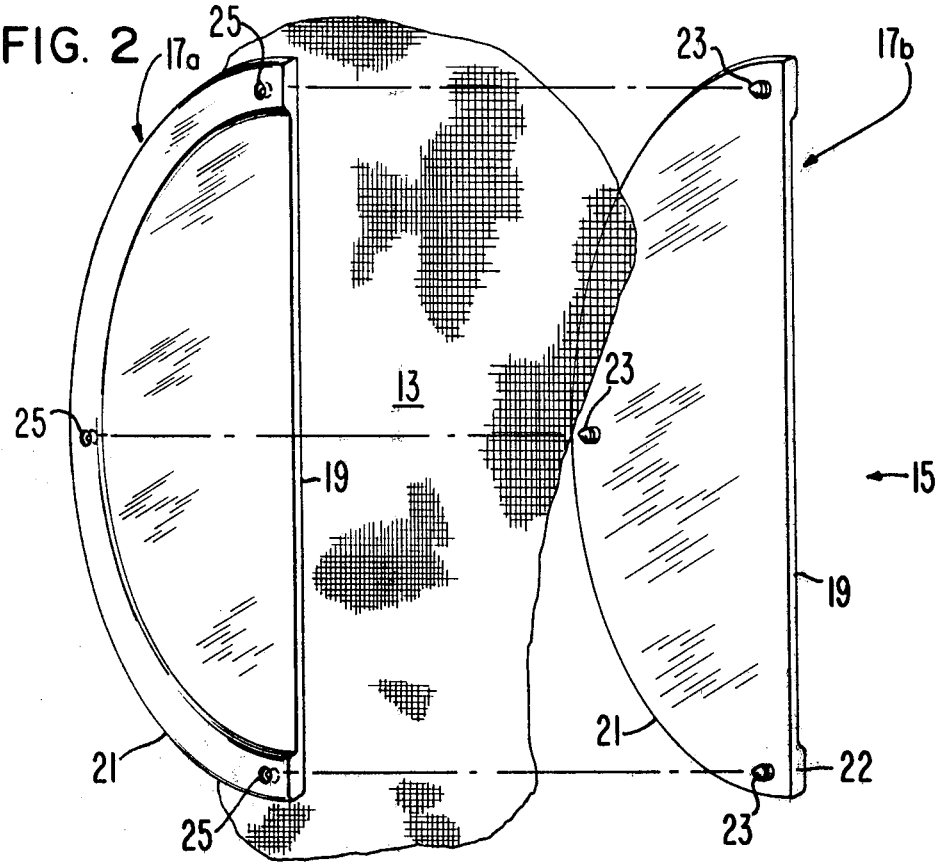
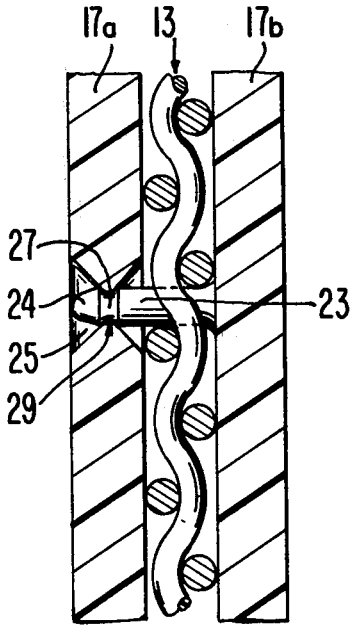
FIG. 3

TRANSPARENT OVERLAY DEVICE FOR PROTECTING MESH SCREENING

BACKGROUND OF THE INVENTION

The present invention is concerned generally with the prevention of accidental damage to the mesh screening used in screen doors, and particularly with the prevention of accidental bulging, rending and puncturing which often occur in that region of the mesh screening which is adjacent to a handle or pull. The sort of damage which occurs in this portion of the screening is usually occasioned by accidental pressure of the human hand on the screening instead of on the handle, which occurs in all too many cases because the handle itself is too small or improperly shaped to permit a ready grasp in the humand hand. Under these conditions actual contact and pressure between the fingers of the hand and the screening over a period of time causes unsightly bulging and puncturing or tearing of the screening material. These problems are particularly severe in the case of mesh screening made of lightweight or fairly stretchable materials, however, no mesh screening can for long withstand the continuous application of pressure without yielding in some way.

Although it might seen that an approach to the solution of this problem would be simply to adopt a much stronger grade of mesh screening for use in window and door screens, both economics and aesthetics generally argue against this approach. This is particularly so because there is little reason to provide extra strength over the entire surface of the screening, since only the regions adjacent handles, pulls, etc. are subjected to heavy stress.

An alternate approach which is sometimes used is to merely extend the width of the frame surrounding the screening material, such that the human hand does not normally come into contact with the screening during operation of the door or window. Unfortunately, the extra cost and the "heavy" appearance of the widened frame have made this approach unsatisfactory. Moreover, there are already in existence a multitude of screen doors which are so designed as to have inadequate shielding of the screening materials adjacent handles, knobs and pulls. Clearly a solution which can be simply and inexpensively retrofitted to these doors and windows is needed.

In view of the impracticality as noted above of redesigning existing screen frames or of adopting a heavier and stronger grade of mesh screening, there is a need for a device which simply, unobtrusively and inexpensively reinforces just that region of the mesh screen surrounding a handle or pull.

DESCRIPTION OF THE PRIOR ART

U.S. Pat. No. 3,838,539 issued Oct. 1, 1974 to William Gronowicz and covers an "Edge Protector for Sliding Screens". One straight edge of this device is slightly rolled over, so that it extends into the groove along the edge of the screen frame and is held therein by an overlying handle. From the groove at the edge of the frame, Gronowicz' plastic screen protector extends laterally over the adjacent region of the mesh screening to which it is fastened by a series of dots of pressure-sensitive adhesive.

Thus the device of Gronowicz is quite limited in the range of its application, since it must be used in combination with a grooved-type screen frame, and with a handle which overlays the plastic protective device and holds it in place. Installation is not as simple as it could be since in order to mount the protective device in place on the screen, the handle must first be removed. In the case of screen doors which do not have such a closely overlaying handle, the device of the Gronowicz patent is hardly usable at all.

The Gronowicz device is also less than ideal because of the fact that it is usable on only one side of the screen, namely, the side which has the screen-mounting groove. This fact, plus the use of relatively insecure adhesive dots, means that the device cannot provide adequate protection to the screening material against pressure from both sides, as is desirable especially in the case of a sliding screen door onto a patio.

SUMMARY OF THE INVENTION

The principal object of the present invention is to provide for the reinforcement of mesh screening in the areas around handles and pulls of screen doors.

A second object of the present invention is to accomplish the preceding object by means which are inexpensive, unobtrusive, and simple and rapid mounting.

A third object of the present invention is to provide a screen shield device in the form of two separate plate members which reinforce the screening material from both sides thereof.

A fourth object of the present invention is to provide a screen shield device with a locking means which passes through the apertures of the screen substantially without damage thereto.

To the above ends, the screen protective device according to the present invention consists of a pair of plastic sheets of virtually identical shape, each having one straight edge for abutment with the edge of the screen door frame. One of the plastic sheets has projecting from a face thereof a plurality of peg members which are dimensioned to essentially fit within the apertures of the mesh screen. The other plastic sheet has a corresponding plurality of apertures dimensioned to receive the peg members.

A further feature of the device is that each peg member has an annular groove extending around its periphery at a location selected such that when this annular groove is engaged by a reduced diameter portion of the corresponding aperture, the two plastic sheets are securely locked together in sandwich fashion with the mesh screen material between them.

These and other features, objects, and advantages of the present invention together with the best mode contemplated by the inventors for carrying out the invention will become apparent from reading the following detailed description of a preferred embodiment and perusing the drawings in which:

BRIEF DESCRIPTION OF THE DRAWINGS

FIG. 2 is an exploded perspective view of the screen protective device according to the present invention;

FIG. 3 is a highly magnified view partially in elevation and partially in section showing fastener means used in mounting the reinforcing device of the present invention on a section of mesh screening.

DETAILED DESCRIPTION OF A PREFERRED EMBODIMENT

Figure 1:
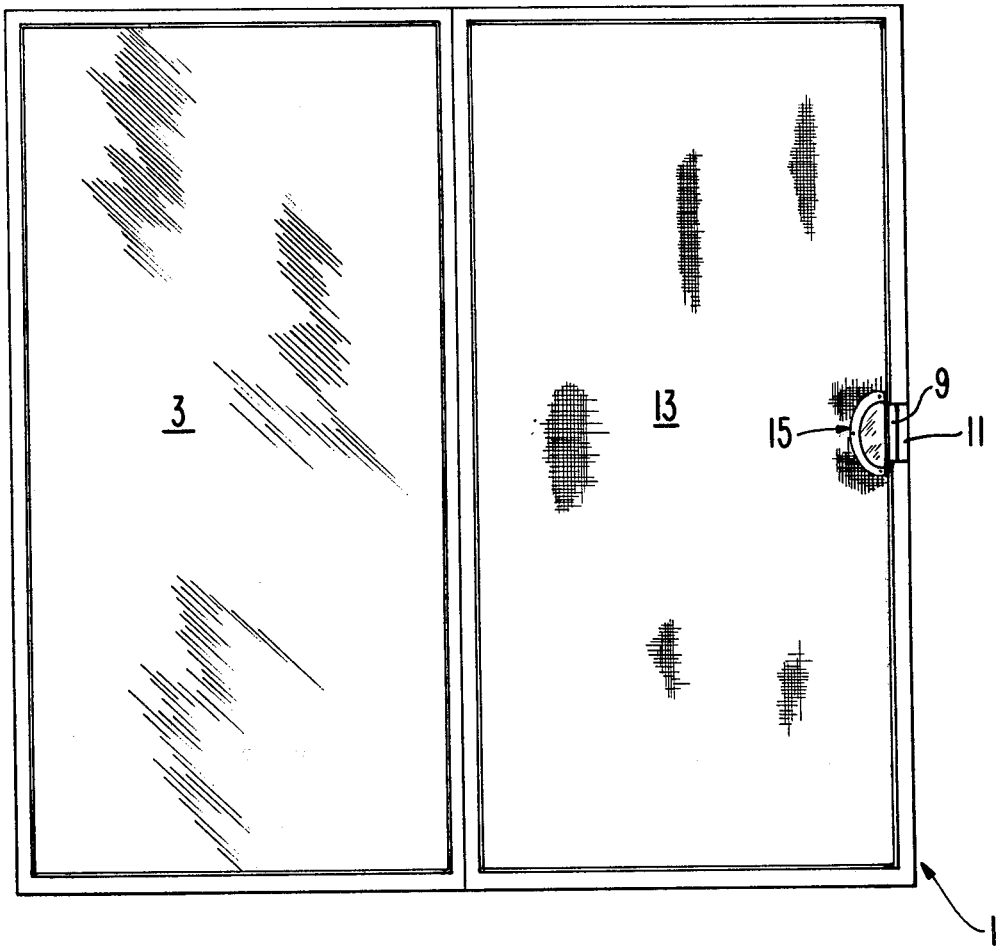
FIG. 1 is an illustration in plan view of a sliding screen door on which the screen protective device of the present invention has been mounted.

In FIG. 1 a sliding screen door 1, for example a patio door, is shown in plan view, beside a fixed glass window 3, over which screen door 1 can be slid to provide access to a patio. Typically, screen door 1 and glass window 3 would be mounted in a door frame (not shown) which includes tracks to permit such sliding.

Door 1 is opened and closed by grasping a door pull 9 and propelling the door in a sideways direction. A conventional latch mechanism 11 may be included and may contain means to lock door 1 shut.

Door pull 9 may be any of a variety of shapes and types, but it might most typically be simply a rectangle of plastic with a shallow depression to engage (somewhat inadequately and insecurely) the fingertips of the human hand.

As shown in FIG. 1, a major portion of door 1 consists of an open frame within which is mounted mesh screening 13. Screening 13 might be made of any of the common materials for such screening such as glass fibers or aluminum wire. Screening 13 is typically held under tension by being jammed into a groove around its periphery where it meets the surrounding frame of door 1.

This means of securing screening 13 is perfectly adequate to maintain it in a stretched condition over a long period of time, so long as it is not subjected to any unusual stresses which would tend to stretch or puncture it. Unfortunately, due to carelessness in operating door pull 9, it is very common for people opening or closing door 1 to incidentally exert some accidental pressure against screening 13 in the region adjacent door pull 9. Expecially over a period of time, these accidental pressures against the adjacent region of screening 13 can cause unsightly bulging and eventually fatiguing of the mesh screening material itself, leading to punctures and tears.

In accordance with the present invention, such damage to mesh screening 13 can be virtually eliminated by the provision of a reinforcing device 15, carefully positioned overlaying the region of screening 13 which is likely to be contacted by a hand pulling or pushing on door pull 9.

As can best be seen in FIG. 2, reinforcing device 15 comprises a pair of virtually identical reinforcing plate members 17*a* and 17*b* which differ only because of the presence thereon of the complementary elements of a fastener means, to be described in detail later. As shown in FIG. 2, each of reinforcing plate members 17*a* and 17*b* has one long straight edge 19 in order to provide a close fitting abutment with the edge of a rectangular screen frame. The other edge 21 of plate members 17*a* and 17*b* has been illustrated in FIGS. 1 and 2 as being semicircular such that in FIG. 1, for example, the zone of reinforcement around door pull 9 extends out to a radius equal to the radius of semicircular edge 21 of plate members 17*a* and 17*b*. However, in practice, any other desired shape, chosen for both practical and aesthetic reasons could be used.

As shown, plate members 17*a* and 17*b* are provided with a thickened edge portion 22 both to provide additional reinforcement and, especially, to provide the needed thickness to accommodate the fastener means needed to secure plate members 17*a* and 17*b* together.

Plate members 17*a* and 17*b* are desirably made of any resilient, clear plastic material such as polypropylene, polyethylene, polycarbonate, or high impact polystyrene. If desired, plate members 17*a* and 17*b* could be provided with any of a number of decorative colors or patterns, however, in most cases an unobtrusive appearance is desired, and clear plastic preferred.

As can be seen in both FIGS. 2 and 3, plate members 17*a* and 17*b* are joined together over the region of screening material 13 which it is desired to reinforce and are held together by means of a plurality of fastener means consisting fundamentally of a plurality of peg members 23 on plate member 17*b* which fit into a correspondingly arranged plurality of apertures 25 in plate member 17*a*.

As best shown in FIG. 3, a greatly enlarged detail view showing one of the identical fastener means, peg member 23 is dimensionsed small enough in diameter to be insertable through the apertures of mesh screening 13. For example, peg member 23 might be on the order of 1/16" diameter or thereabouts. In general, the diameter of peg 23 would be chosen as large as practicable in view of the necessity to provide adequate strength, and a reasonably close fit in the openings of mesh screening 13 so that reinforcing device 15 is well supported against lateral movement over the surface of screening 13. In order to facilitate insertion of peg members 23, both through the openings of mesh screening 13 and especially into closely fitting apertures 25, the tip portions 24 of members 23 are preferably tapered as shown in FIG. 3.

In accordance with a further feature of the present invention, peg member 23 is provided with a circumferential, annular recess or groove 27, and aperture 25 is tapered to provide an axial region of reduced diameter 29 so that the two together form a type of locking fastener. As shown in FIG. 3, reduced diameter region 29 is actually smaller in diameter than the peg member 23 except at the region of circumferential groove 27, such that plate members 17*a* and 17*b* must be pressed together with some force in order to engage the circumferential groove region 27 of peg member 23 within the reduced diameter region of aperture 25. However, once these regions are engaged, plates 17*a* and 17*b* are quite securely held together in a more-or-less permanent manner. In other words, reduced diameter region 29 serves as a gripping means for securely engaging peg members 23 at the axial position of groove 27.

The amount of the diametral difference between peg member 23 and region 29 of aperture 25 may be selected in view of the compressibility of the material used to form plate members 17*a* and 17*b*. Similarly, the axial position of circumferential groove 27 along peg member 23 will in practice be selected to produce a slight amount of compression between plate members 17*a* and 17*b* and mesh screening 13, to provide a secure and rattlefree installation.

Furthermore, although the cross-sectional shape of aperture 25 has been illustrated as conical, other shapes could be used depending upon the ease of fabrication and possibly other factors relating to the moldability of the plastic material forming plate members 17*a* and 17*b*. For example, aperture 25 could be formed as simply a stepped bore, e.g., by counterboring from both faces of plate member 17*a*, leaving a thin partition with a central aperture therein of the correct diameter to engage circumferential groove 27. Alternatively, this stepped bore could be produced by molding plate member 17*a* in an appropriately shaped mold. The cross-sectional shape of groove 27 of the peg member 23 illustrated in FIG. 3 is concave towards the long axis of the peg member.

Although the invention has been described with some particularlity in reference to a preferred embodiment comprising the best mode contemplated by the inventors for carrying out their invention, many changes could be made and many alternative embodiments thus derived without departing from the scope of the invention. Consequently, the scope of the invention is to be interpreted only from the following claims.

What is claimed is:

1. A protective overlay device for reinforcing framed mesh screening in an area where stress is applied to the mess screening adjacent a frame supporting said mesh screening comprising:

first and second reinforcing plate members, each member defining opposite parallel faces extending from a single straight edge for abuttment with the frame supporting said framed mesh screening to an edge out of abuttment with said frame;

a plurality of spaced apart peg members secured to the first plate member to define an integral body therewith, each peg member secured at one of its opposite ends to one of the opposite faces of said first plate member at a fixed location to extend along an axis away from said one opposite face to a free end, each peg member formed to have a circumferential region of reduced axial cross section axially spaced from regions of greater axial cross section at its opposite ends with the region defining the free end of the peg member tapered in the direction of the axis of the peg member from a large axial cross section proximate the reduced axial cross section region to a smaller axial cross section at said free end;

a plurality of apertures defined by the second plate member to extend along an axis from one of the opposite faces of said member in a direction towards the other of said member's opposite faces, said apertures being so dimensioned and spaced as to receive therewithin said peg members when said plate members are placed together in face-abutting relationship, each of said apertures having a region of reduced axial cross section axially spaced from regions of greater axial cross section at opposite ends of the aperture; and said regions of reduced axial cross section on said peg members and said apertures having substantially the same axial cross section and said same axial cross section being a smaller axial cross section of each said peg member and aperture than other portions thereof, and said regions of reduced axial cross section being axially positioned respectively on said peg members and in said apertures and the length of each peg member selected such that, when the first and second plate members are assembled with said mesh screening therebetween and said reduced axial cross section regions of said peg members and apertures in mutual engagement, said plate members are relatively immobile with said mesh screening in surface abutting contact with each of said plate members and the free ends of the peg members terminate within the apertures.

2. The device according to claim 1 wherein the reinforcing plate members are of resilient material, the region of reduced axial cross section of each aperture having a longitudinal cross section defined by a pair of conical longitudinal cross section portions each extending from a small cross section midway along the aperture's axis to a large cross section at one of the ends of the aperture, and the circumferential region of reduced cross section of each peg member having a longitudinal cross section that is concave towards the axis of the peg member.

* * * * *